US006176381B1

(12) United States Patent
Mader

(10) Patent No.: US 6,176,381 B1
(45) Date of Patent: Jan. 23, 2001

(54) CHILD RESISTANT CONTAINER SYSTEM WITH MOVABLE LATCH

(76) Inventor: Stanley C. Mader, 301 Windermere Ave., Asbury Park, NJ (US) 07712

( * ) Notice: Under 35 U.S.C. 154(b), the term of this patent shall be extended for 0 days.

(21) Appl. No.: 09/477,339

(22) Filed: Jan. 4, 2000

(51) Int. Cl.[7] ..... B65D 55/02

(52) U.S. Cl. ..... 215/219; 215/220; 215/221; 215/217

(58) Field of Search ..... 215/217, 219, 215/220, 221, 303–305, 330, 210, 203, 206; 220/324, 326

(56) References Cited

U.S. PATENT DOCUMENTS

| | | | | |
|---|---|---|---|---|
| 2,772,803 | | 12/1956 | Pasquariello . | |
| 3,160,301 | | 12/1964 | Milbourne . | |
| 3,311,247 | * | 3/1967 | Rigor | 215/221 X |
| 3,376,992 | | 4/1968 | Klapp, Sr. . | |
| 3,394,830 | | 7/1968 | Schiavo . | |
| 3,514,003 | | 5/1970 | Fitzgerald . | |
| 3,779,414 | | 12/1973 | Jones . | |
| 3,868,041 | * | 2/1975 | Knize | 220/324 |
| 3,902,620 | | 9/1975 | McIntosh . | |
| 4,071,064 | * | 1/1978 | Saul . | |
| 4,106,651 | | 8/1978 | Lemons . | |
| 4,154,353 | | 5/1979 | Hoo . | |
| 4,512,484 | | 4/1985 | Mar . | |
| 4,934,547 | | 6/1990 | Mayes et al. . | |
| 4,989,739 | | 2/1991 | Falcone et al. . | |
| 5,046,629 | | 9/1991 | Weile . | |
| 5,082,129 | | 1/1992 | Kramer . | |
| 5,115,928 | | 5/1992 | Drummond, Jr. . | |
| 5,170,900 | | 12/1992 | Manera . | |
| 5,277,325 | | 1/1994 | Yan . | |
| 5,284,262 | | 2/1994 | O'Nan . | |
| 5,449,077 | * | 9/1995 | Seidler | 215/221 X |
| 5,462,182 | | 10/1995 | Opresco . | |
| 5,769,252 | | 6/1998 | Volpe . | |
| 5,788,098 | | 8/1998 | Mader . | |

FOREIGN PATENT DOCUMENTS

| | | | | |
|---|---|---|---|---|
| 244568 | * | 4/1947 | (CH) | 215/330 |
| 2545791 | * | 11/1984 | (FR) | 215/217 |
| 296660 | * | 12/1990 | (JP) | 220/324 |

* cited by examiner

*Primary Examiner*—Stephen K. Cronin
*Assistant Examiner*—Robin A. Hylton
(74) *Attorney, Agent, or Firm*—Nixon & Vanderhye P.C.

(57) ABSTRACT

A child resistant container system includes an open top container having screw threads cooperating with screw threads on a closure cap. The cap is locked in the screwed on position by a reciprocating or pivotal latch mounted to the container which slides or pivots into a recess on the cap. Preferably a stop element, such as a stop ring, having a recess cooperating with the cap recess, is also provided, the latch moving into the aligned recesses on the cap and stop element to securely preclude rotation of the cap with respect to the container.

20 Claims, 7 Drawing Sheets

CHILD RESISTANT CONTAINER SYSTEM WITH MOVABLE LATCH

BACKGROUND AND SUMMARY OF THE INVENTION

In U.S. Pat. No. 5,788,098, the disclosure of which is hereby incorporated by reference herein, an effective child resistant container closure system for any type of conventional container is provided that is highly effectively yet simple. The system as disclosed in the U.S. Pat. No. 5,788,098 Patent is readily adapted for use as either a child resistant, or non-child resistant container, which can be readily determined at the point of purchase. While the system disclosed in that patent is highly effective for many circumstances, under some circumstances it is desirable to provide an even more simplified child resistant container system which the user can optionally use or not use.

The child resistant container system according to the present invention provides at least one recess in the cap for the container into which a latch element may be moved. The general concept of moving a latch element into a recess is well known in the art per se, such as shown in U.S. Pat. Nos. 3,514,003, 4,989,739, and 5,115,928, but in conventional systems the latch element is typically associated with the container top and a relatively complex arrangement is provided. Also because the association with the container top typically such latches, if not utilized, either provide exposed parts on the cap, or provide a cap that is not aesthetic. Also, because the cap is a relatively small element the machining or molding of the components is relatively difficult and the caps may be expensive.

According to the present invention a child resistant container system, and a method of utilization thereof are provided which are greatly simplified with respect to the prior art, utilizes a cap without any moving parts, and provides a secure latch system which either may be used or not used by the purchaser.

According to one aspect of the present invention a child resistant container system is provided comprising the following components: An open top container having a first set of surface manifestations adjacent the open top, and a stop element on the opposite side of the surface manifestations from the open top. A closure cap having a top surface, and second set of surface manifestations which cooperate with the first set of surface manifestations in a closed position of the cap on the container to preclude movement of the cap away from the container in a dimension uncovering the open top. At least one first recess in the stop element, and at least one second recess in the cap extending substantially perpendicular to the top surface, the first and second recesses aligned when the cap and container are in the closed position. And a latch mounted to the container on the opposite side of the stop element from the first set of surface manifestations for movement from a first position in which the latch is spaced from the recesses, to a second position in which the latch extends into both of the recesses and prevents relative rotational movement between the cap and stop container.

Preferably the first and second recesses comprise channel shaped recesses. The latch may comprise a slide having a finger engaging portion and mounted for reciprocal movement with respect to the container to reciprocate into the first recess and then the second recess to preclude relative rotation between the cap and the container. The at least first and second recesses preferably comprise a single first recess and a single second recess, although multiple second recesses may be provided especially where the surface manifestations are anything aside from screw threads. Typically, however, the first and second surface manifestations comprise external and internal screw threads, respectively. The slide may be mounted for reciprocation by a single guide pin extending outwardly from the container and having a shaft engaging a slide track in the slide, and having a head on the opposite side of the slide from the container which prevents the pin from becoming completely separated from the slide; and wherein the slide track and pin are positioned and dimensioned so that the slide is always in the first recess.

Alternatively, the latch may comprise a lever pivotally mounted to the container, and pivotal into the first recess and then the second recess to preclude relative rotation between the cap and container. The stop element may comprise a stop ring, and the container may comprise a vial, bottle, or any other conventional container.

While the system as described is preferred, under some circumstances it is possible to eliminate the stop ring/element and just rely on the engagement between the latch and the recess in the cap to preclude relative rotation between the cap and container when latched together. Pursuant to this embodiment the child resistant container system comprises the following components: An open top container having a first set of surface manifestations adjacent the open top. A closure cap having a top surface, and second set of surface manifestations which cooperate with the first set of surface manifestations in a closed position of the cap on the container to preclude movement of the cap away from the container in a dimension uncovering the open top. At least one first recess in the cap extending substantially perpendicular to the top surface. And a latch mounted to the container on the opposite side of the first set of surface manifestations from the open top, for movement from a first position in which the latch is spaced from the first recess, to a second position in which the latch extends into the first recess and prevents relative rotational movement between the cap and stop container. The details of the container system may be as described above. Where the slide embodiment for the lever is utilized, the slide may be mounted for reciprocation by a single guide pin extending outwardly from the container and having a keyed shaft engaging a keyed slide track in the slide, and having a head on the opposite side of the slide from the container which prevents the pin from becoming completely separated from the slide.

According to another aspect of the present invention a method of using a container system comprising a container having internal screw threads adjacent an open top thereof and a stop element opposite the threads from the open top, a closure cap having a top surface and internal screw threads which can cooperate with the external screw threads on the container, at least one recess in each of the cap and stop element, and a latch mounted to the container on the opposite side of the stop element from the screw threads and movable with respect to the container, is provided. The method preferably comprises: (a) Screwing the cap onto the container so that the external and internal screw threads cooperate so that at least one recess in the cap is in substantial alignment with at least one recess in the stop element; and (b) moving the latch with respect to the container and substantially aligned recesses so that the latch penetrates both of the recesses and precludes relative rotation of the cap with respect to the container.

It is the primary object of the present invention to provide a simple yet effective and inexpensive child resistant container system, and a simple method of utilization thereof.

This and other objects of the invention will become clear from an inspection of the detailed description of the invention and from the appended claims.

DETAILED DESCRIPTION OF THE DRAWINGS

Figure 1:
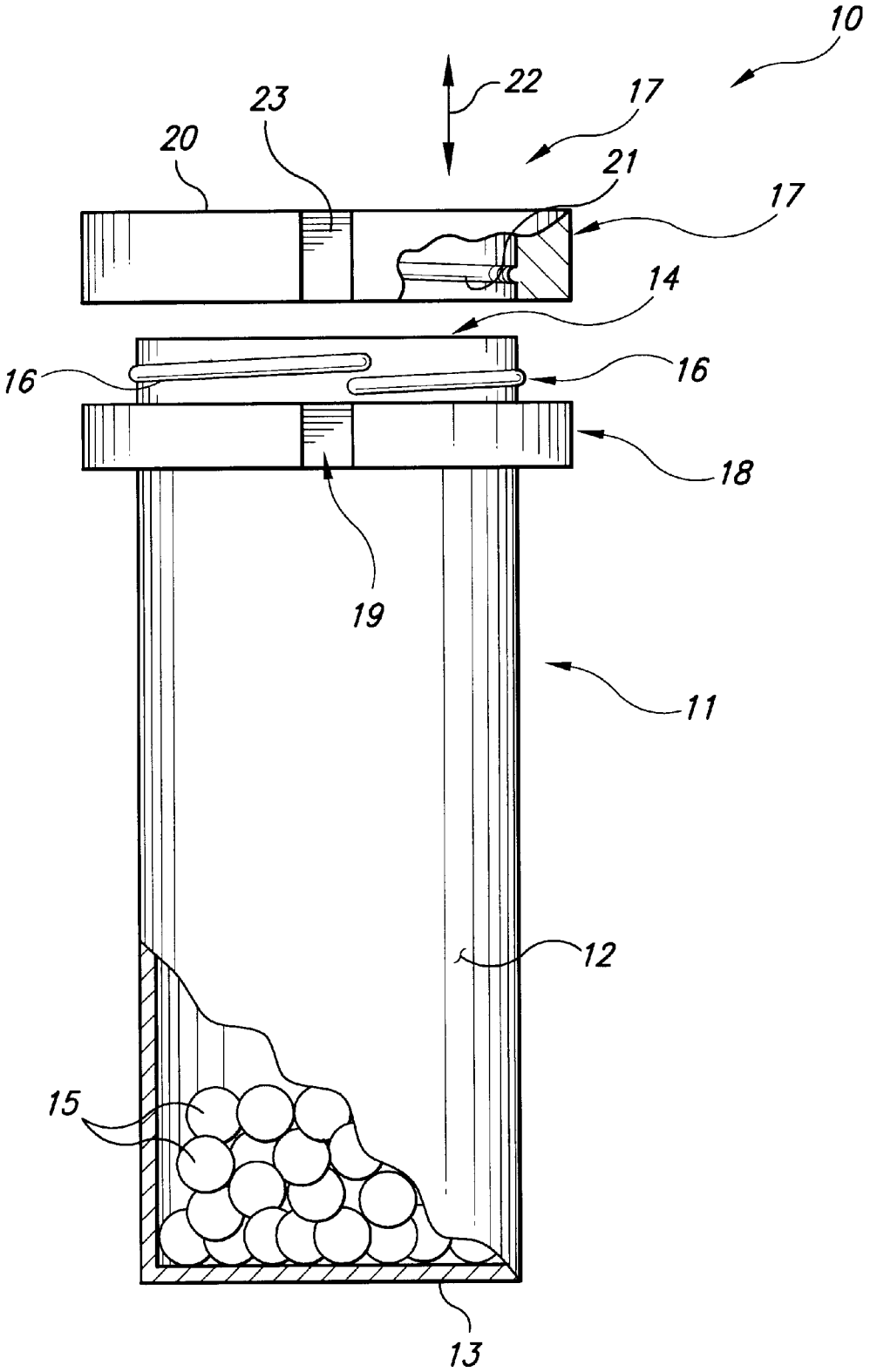
FIG. 1 is a side view, partly in cross section and partly in elevation, of an exemplary container system according to the present invention, but with a latch element removed for clarity of illustration.
Figure 2:
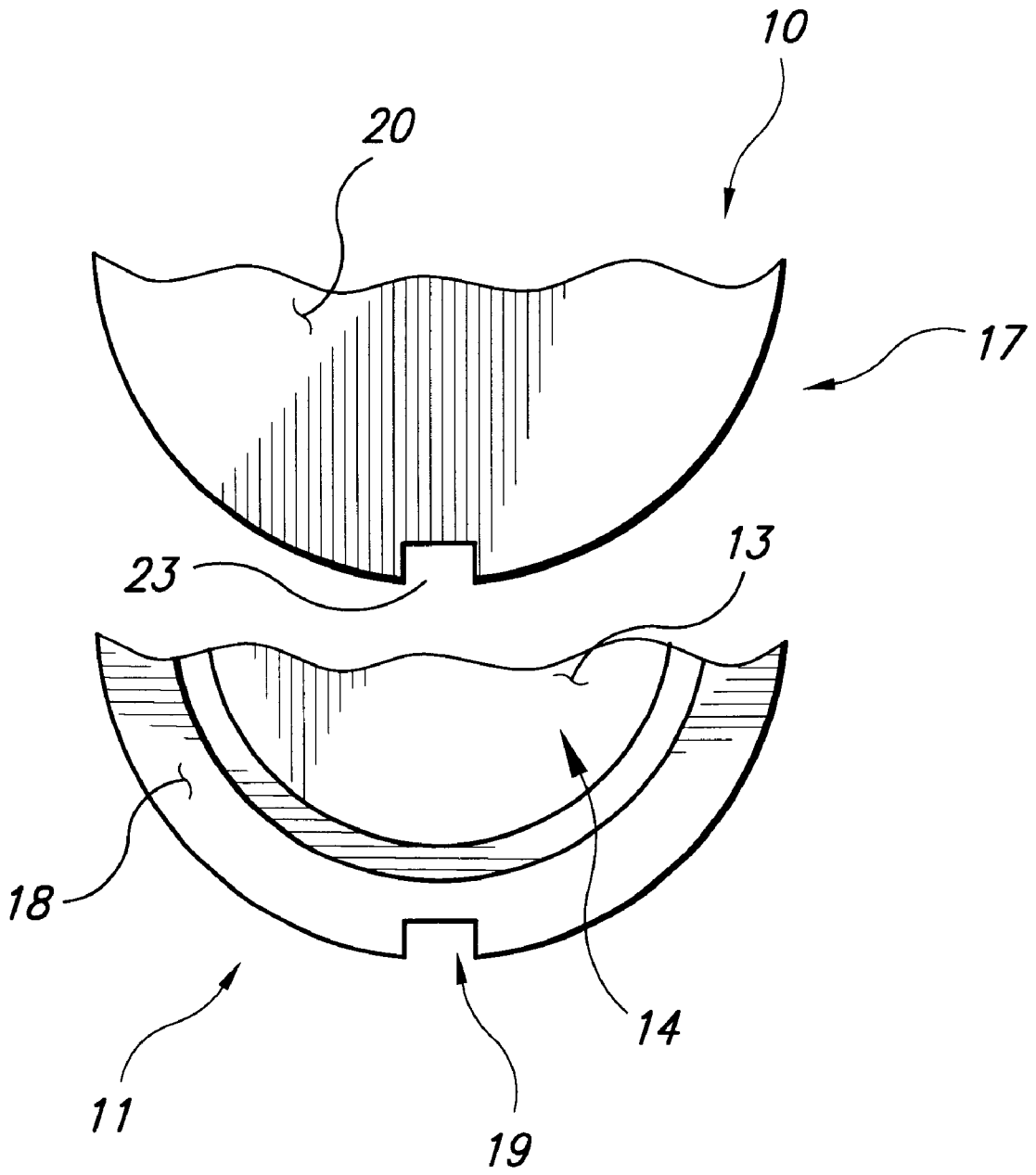
FIG. 2 is a partial top plan view of the cap and open top of the container of the FIG. 1 embodiment.

FIGS. 1 and 2 illustrate one embodiment of an exemplary container system 10 according to the present invention, but with the latch element removed for clarity of illustration. The first element of the system 10 illustrated in FIGS. 1 and 2 comprises an open top container 11. In the embodiment illustrated in FIGS. 1 and 2 the container 11 comprises a vial having a cylindrical side wall 12, a closed bottom 13, and an open top 14. However, it is to be understood that the container 11 may comprise any suitable conventional container, such as a bottle (as disclosed in U.S. Pat. No. 5,788,098) or any other type of conventional container that desirably has a child resistant feature because the material or materials contained therein, such as the pills 15 illustrated in FIG. 1, is or are potentially toxic non-food items.

The container 11 also comprises a first set of surface manifestations 16 adjacent the open top 14. The illustrated surface manifestations 16 are external screw threads, although other types of surface manifestations that can provide cooperation between a cap 17 and container 11, such as bayonet or other conventional surface manifestations, may be provided.

In the preferred embodiment illustrated in FIGS. 1 and 2, the container 11 also comprises a stop element 18. In the embodiment illustrated in FIGS. 1 and 2 the stop element 18 is illustrated as a stop ring, but it is to be understood that other stop elements may be provided, such as portions of a ring, simple projections, or the like, as long as the stop element 18 defines at least one first recess 19. The recess 19 may have a variety of configurations, such as a simple straight through opening enclosed on all sides, but in the preferred embodiment illustrated in FIGS. 1 and 2 the recess 19 comprises a channel-shaped recess, that is having an open top, which defines an open side when the container has the orientation illustrated in FIG. 1. Preferably a single recess 19 is provided.

The cap 17 has a top surface 20, which is closed, and a second set of surface manifestations, such as the internal screw threads 21 (see FIG. 1) which cooperate with the screw threads 16 to hold the cap 17 in place on the container 11. Again the surface manifestations 21 can comprise other conventional surface manifestations aside from screw threads as long as they are effective, when cooperating with the surface manifestations 16, to substantially preclude detachment of the cap 17 from the container 11 in the dimension 22, substantially perpendicular to the top surface 20 of the cap 17.

Figure 3:
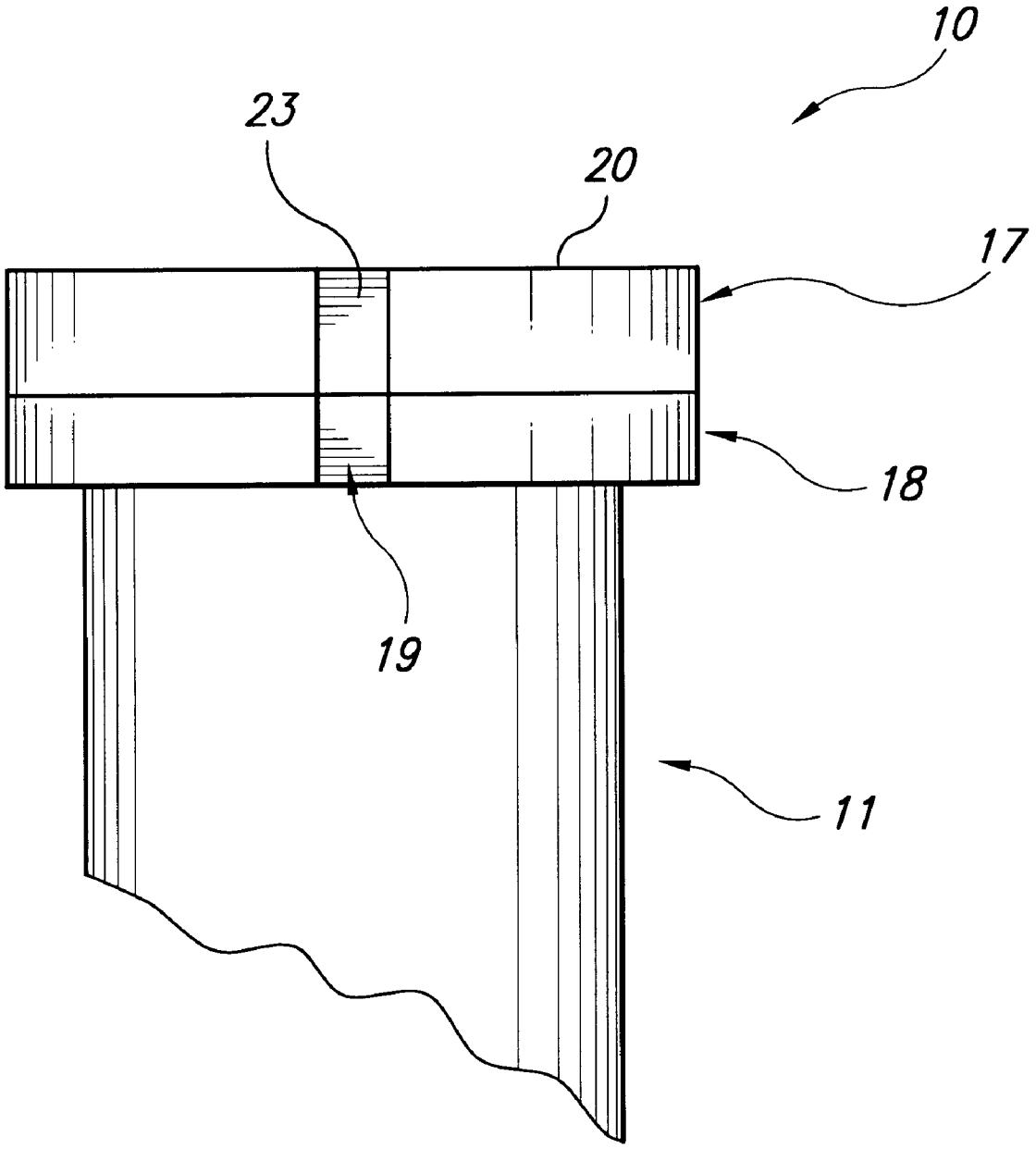
FIG. 3 is a side elevational view like that of FIG. 1 with the cap in place and the recesses on the cap and stop element aligned.

The cap 17 also comprises at least one second recess 23 which also may comprise any suitable type, but in the preferred embodiment illustrated in the drawings comprises a channel-shaped recess. The recesses 19, 23 preferably are of substantially the same size and shape and are adapted to cooperate, being aligned with each other as illustrated in FIG. 3, when the cap 17 is properly screwed onto (or otherwise attached to) the container 11.

Figure 4:
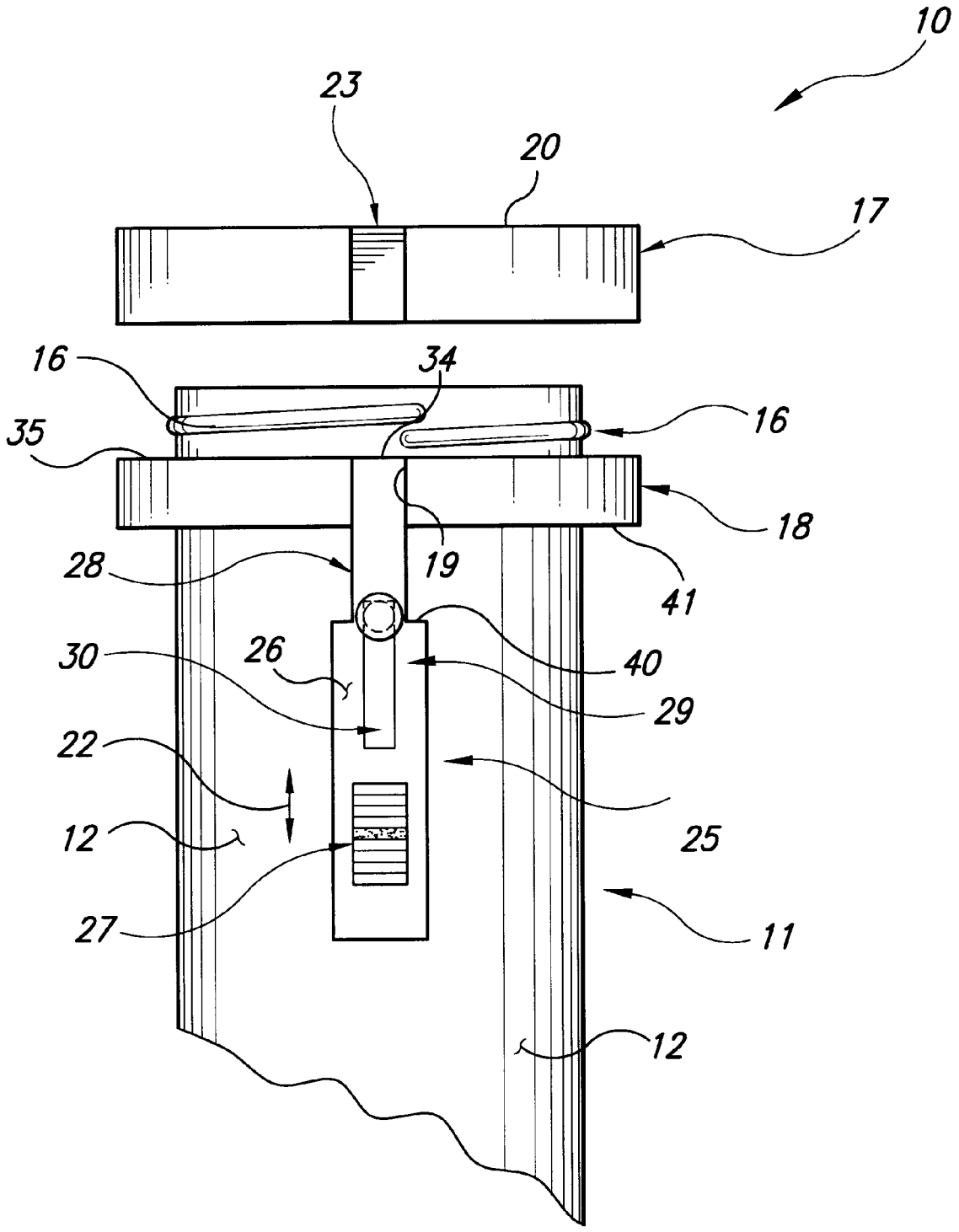
FIG. 4 is a view like that of FIG. 1 only with a reciprocating latch element shown mounted on the container.
Figure 6:
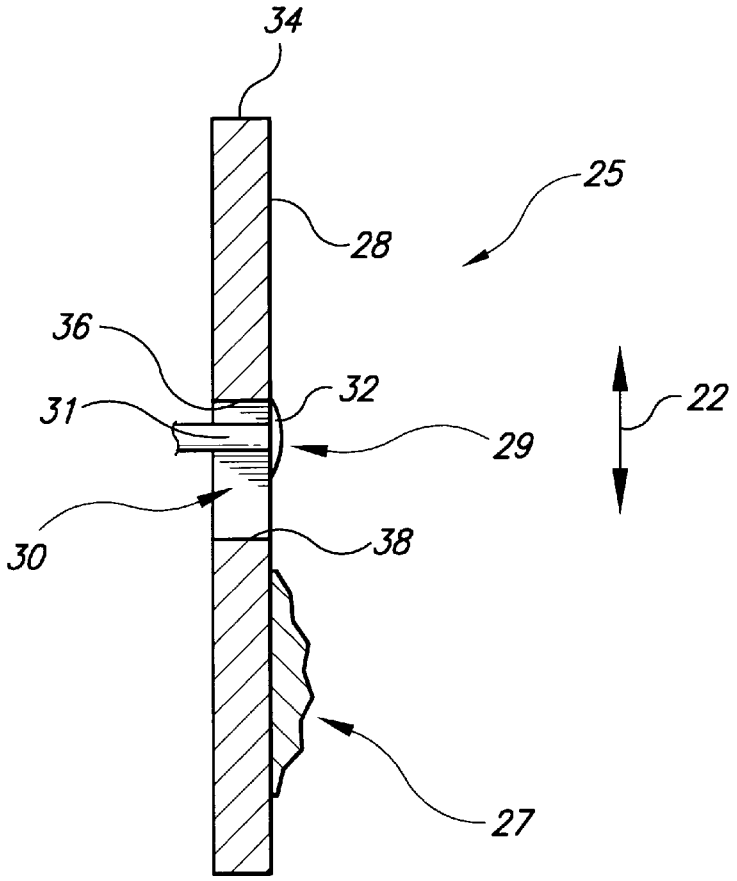
FIG. 6 is a side view, partly in cross section and partly in elevation, of one embodiment latch element per se of FIGS. 4 and 5.
Figure 7:
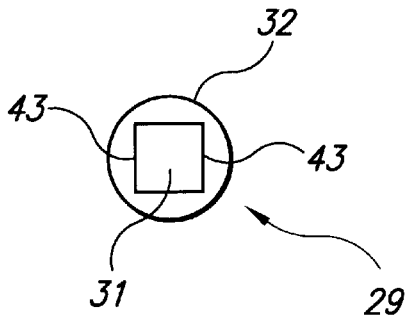
FIG. 7 is a bottom plan view of an exemplary pin for the latch element of FIG. 6.

FIG. 4 is a view like that of FIG. 1 only showing the further element of the system 10 according to the present invention, namely a latch, shown generally by reference numeral 25 in FIG. 4. In the embodiment illustrated in FIGS. 4 through 7 the latch 25 comprises a slide having a body 26 with a finger engaging projection 27 extending upwardly therefrom at the bottom thereof, as illustrated in FIG. 4, a locking flange portion 28, a guide pin 29, and a slide track 30. As illustrated in FIGS. 6 and 7, the pin 29 has a shaft 31 which is disposed in the slide track 30 and guides reciprocation of the slide 25 in the dimension 22. The pin 29 also has a head 32 opposite the container wall 12 from the slide 25 to hold the slide 25 to the container 11. The shaft 31 is either integral with the container wall 12, or screwed, welded, riveted, or otherwise securely fit into the container wall 12.

In the embodiment illustrated in FIGS. 4 and 5, the slide 25, as well as the pin 29 and track 30, are dimensioned and positioned so that the locking flange portion 28 is always in the recess 19, with the distal end 34 of the slide 25 even with, or below, the top surface 35 of the stop ring 18. That is, when the "upper" portion 36 of the recess 30 (as seen in FIG. 6) engages the shaft 31 of the guide pin 29 the distal portion 34 of the locking flange 28 is substantially at or just below the surface 35.

Figure 5:
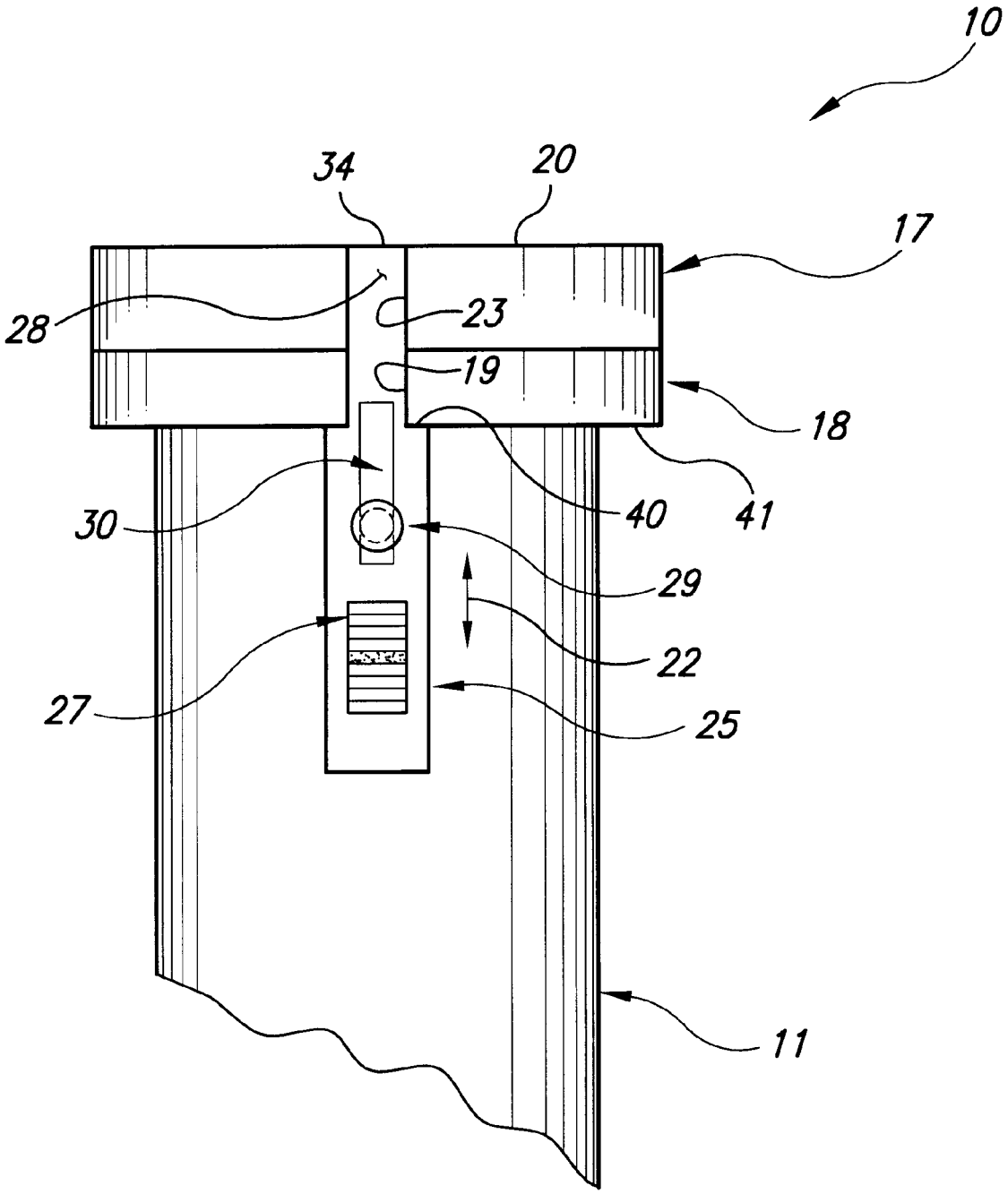
FIG. 5 is a view like that of FIG. 4 only with the latch element moved into the latching position.

Once the cap 17 is screwed into place on the container 11—as illustrated in FIG. 5—the slide 25 is reciprocated in the dimension 22 to move the locking flange 28 so that it penetrates the recess 23, desirably so that the distal portion 34 thereof is substantially even with or just below the top surface 20 of the cap 17 as illustrated in FIG. 5. In this position the "lower" portion 38 (see FIG. 6) of the track 30 engages the guide pin shaft 31 to preclude further upward movement (as seen in FIG. 5) of the slide 25. Also a further stop, or alternative stop, may be provided by the shoulder 40 of the slide 25, which is between the body 26 and the flange 28, which engages the bottom surface 41 of the stop ring 18.

While it is preferred for durability and secure latching purposes that the stop element 18 be provided, under some circumstances just the recess 23 in the cap 17 may be utilized to latch the cap 17 in place. In such a case there either is desirably a second pin and channel associated with the slide 25 and the container 11, or—as illustrated in FIG. 7—the shaft 31 of the pin 29 is keyed to the slide track 30 by having the surface configuration of the shaft 31 and the slide 30 match to provide resistance to pivotal movement of the slide 25 about the pin 29. In the embodiment illustrated in FIG. 7 the shaft 31 has a square or rectangular configuration with the side walls 43 thereof keyed to (engaging the side walls of) the slide track 30.

Figure 8:
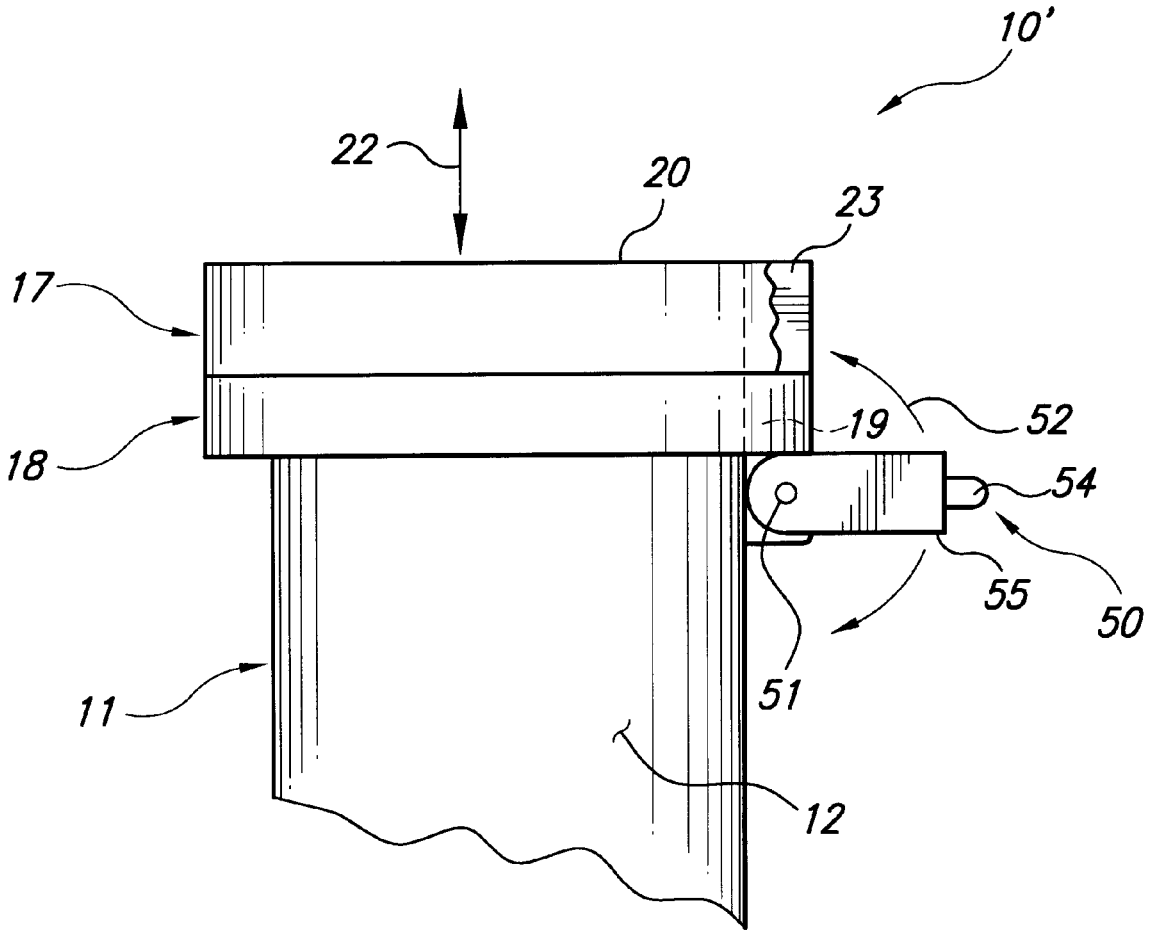
FIG. 8 is a side elevational view, with part of the cap at the recess cut away for clarity of illustration, of a second embodiment having a pivotal latch element.

FIG. 8 illustrates another embodiment of a container system 10' according to the present invention. In the embodiment of FIG. 8 all of the components that are the same as those in the FIGS. 1 through 7 embodiment are shown by the same reference numeral.

The only significant difference between the embodiment of FIG. 8 and that of FIGS. 1 through 7 is the particular nature of the latch. In the embodiment illustrated in FIG. 8 instead of the latch being slidable the latch comprises a lever 50 pivotally mounted, by pivot pin 51 in the exemplary embodiment illustrated in FIG. 8, for movement about a pivot axis—as indicated by the arrows 52 in FIG. 8—that are substantially perpendicular to the dimension 22. The lever 50 is positioned immediately adjacent the recess 19 in the stop ring 18, and when the cap 17 is screwed onto the container 11 to close the open top 14 thereof and the recesses 23, 19 aligned, the lever 50 is pivoted upwardly as indicated by the top arrow 52 in FIG. 8 to enter the first recess 19 and then the second recess 23 to latch the cap 17 in place so that it cannot be rotated with respect to the container 11. When it is desired to release the latch, the user engages the tapered top portion 54 of the lever 50 with his or her finger or an implement, and pivots the lever 50 downwardly about the pivot pin 51, shown by the lower arrow 52 in FIG. 8, to a position in which the bottom side surface 55 of the lever 50 is flush with and engages the container side wall 12. In the latched position of the lever 50 the projection 54 is preferably below the top surface 20 of the cap 17.

The various components of the container systems 10, 10' may be made of any desirable materials, such as a wide variety of substantially rigid plastics, glass, or metal, or a combination of those components. If desired the guide pin 29 of the pivot pin 51 can be constructed so that they are removable by using a screw driver, punch, or like implement, so that the system 10, 10' can be sold as a simple container rather than one with a child resistant latching system.

In a typical manner the use of the container system 10, 10', the cap 17 is screwed or otherwise moved into operative association to close the open top of the container 11, such as by the external 16 and internal 21 screw threads engaging with each other, the screwing on, or other rotational movement, taking place until the recess 23 in the cap 17 is substantially aligned with the recess 19 in the stop element 18, and then the latch 25, 50 is moved with respect to the aligned recesses 19, 23 so that the latch 50, 28 penetrates both of the recesses 19, 23 and precludes relative rotation of the cap 17 with respect to the container 11. Preferably the recesses 19, 23 are channel-shaped (have an open top/sides) for simplicity and so as to enhance the ease of the latching and unlatching movements.

While it is preferred that only one latch 25, 50 is used with a container, multiple latches (and cooperating recesses 19, 23) may be utilized if desired.

It will thus be seen that according to the present invention a very simple, inexpensive, yet secure child resistant container system, and method of utilization thereof, are provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A child resistant container system, comprising:

an open top container having a first set of surface manifestations adjacent said open top and a stop element on the opposite side of said surface manifestations from said open top;

a closure cap having a top surface and second set of surface manifestations which cooperate with said first set of surface manifestations in a closed position of said cap on said container to preclude movement of said cap away from said container in a dimension uncovering said open top;

at least one first recess in said stop element, and at least one second recess in said cap extending substantially perpendicular to said top surface, said first and second recesses aligned when said cap and container are in said closed position; and a latch mounted to said container on the opposite side of said stop element from said first set of surface manifestations for movement from a first position in which said latch is spaced from said recesses, to a second position in which said latch extends into both of said recesses and prevents relative rotational movement between said cap and stop container.

2. A container system as recited in claim 1 wherein said first and second recesses comprise channel-shaped recesses.

3. A container system as recited in claim 2 wherein said latch comprises a slide having a finger-engaging projection, and mounted for reciprocal movement with respect to said container to reciprocate from said first recess into said second recess to preclude relative rotation between said cap and container.

4. A container system as recited in claim 3 wherein said at least one first and second recesses comprise a single first recess and a single second recess, and said latch comprises a single latch.

5. A container system as recited in claim 3 wherein said first and second surface manifestations comprise cooperating external and internal screw threads, respectively.

6. A container system as recited in claim 5 wherein said slide is mounted for reciprocation by a single guide pin extending outwardly from said container and having a shaft engaging a slide track in said slide, and having a head on the opposite side of said slide from said container which prevents said pin from becoming completely separated from said slide; and wherein said slide track and pin are positioned and dimensioned so that said slide is always in said first recess.

7. A container system as recited in claim 2 wherein said latch comprises a lever pivotally mounted to said container, and pivotal into said first recess and then said second recess to preclude relative rotation between said cap and container.

8. A container system as recited in claim 7 wherein said at least one first and second recesses comprise a single first recess and a single second recess.

9. A container system as recited in claim 7 wherein said first and second surface manifestations comprise cooperating external and internal screw threads, respectively.

10. A container system as recited in claim 1 wherein said latch comprises a slide having a finger-engaging projection, and mounted for reciprocal movement with respect to said container to reciprocate from said first recess into said second recess to preclude relative rotation between said cap and container.

11. A container system as recited in claim 10 wherein said slide is mounted for reciprocation by a single guide pin extending outwardly from said container and having a shaft engaging a slide track in said slide, and having a head on the opposite side of said slide from said container which prevents said pin from becoming completely separated from said slide; and wherein said slide track and pin are positioned and dimensioned so that said slide is always in said first recess.

12. A container system as recited in claim 1 wherein said stop element comprises a stop ring.

13. A container system as recited in claim 1 wherein said container comprises a vial or a bottle; and wherein said stop element comprises a stop ring.

14. A child resistant container system, comprising:

an open top container having a first set of surface manifestations adjacent said open top;

a closure cap having a top surface and second set of surface manifestations which cooperate with said first set of surface manifestations in a closed position of said cap on said container to preclude movement of said cap away from said container in a dimension uncovering said open top;

at least one first recess in said cap extending substantially perpendicular to said top surface;

a latch mounted to said container on the opposite side of said first set of surface manifestations from said open top, for movement from a first position in which said latch is spaced from said first recess, to a second position in which said latch extends into said first recess and prevents relative rotational movement between said cap and stop container;

wherein said latch comprises a slide having a finger-engaging projection, and mounted for reciprocal movement with respect to said container to reciprocate into said first recess to preclude relative rotation between said cap and container; and wherein said slide is mounted for reciprocation by a single guide pin extending outwardly from said container and having a keyed shaft engaging a keyed slide track in said slide, and having a head on the opposite side of said slide from said container which prevents said pin from becoming completely separated from said slide.

15. A container system as recited in claim 14 wherein said at least one first recess comprises at least one channel-shaped recess.

16. A container system as recited in claim 15 wherein said at least one first recess comprises a single first recess, and said latch comprises a single latch.

17. A method of using a container system comprising a container having internal screw threads adjacent an open top thereof and a stop element opposite the threads from the open top, a closure cap having a top surface and internal screw threads which cooperate with the external screw threads on the container, at least one recess in each of the cap and stop element, and a latch mounted to the container on the opposite side of the stop element from the screw threads and movable with respect to the container, said method comprising:

(a) screwing the cap onto the container so that the external and internal screw threads cooperate so that at least one recess in the cap is in substantial alignment with at least one recess in the stop element; and (b) moving the latch with respect to the container and substantially aligned recesses so that the latch penetrates both of the recesses and precludes relative rotation of the cap with respect to the container.

18. A method as recited in claim 17 wherein the latch comprises a slide, and wherein (b) is practiced to reciprocate the slide to move it from a non-latching position in which it penetrates only one recess to a latching position in which it penetrates both recesses.

19. A method as recited in claim 17 wherein the latch comprises a lever pivotally mounted to the container, and wherein (b) is practiced to pivot the lever from a non-latching position in which it does not penetrate either recess, to a latching position in which it penetrates both recesses.

20. A method as recited in claim 17 wherein the latch comprises a single latch, and wherein the at least one recess in each of the cap and the stop element comprises a single recess in each of the cap and the stop element; and wherein (b) is practiced to move the single latch into the single recesses in both the cap and the stop element.

* * * * *